US011034908B2

(12) United States Patent
Kusumoto et al.

(10) Patent No.: US 11,034,908 B2
(45) Date of Patent: Jun. 15, 2021

(54) LUBRICANT COMPOSITION

(71) Applicant: IDEMITSU KOSAN CO., LTD., Chiyoda-ku (JP)

(72) Inventors: Tatsuya Kusumoto, Chiba (JP); Ikuko Nakaya, Ichihara (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 32 days.

(21) Appl. No.: 16/088,526

(22) PCT Filed: Mar. 30, 2017

(86) PCT No.: PCT/JP2017/013426

§ 371 (c)(1),
(2) Date: Sep. 26, 2018

(87) PCT Pub. No.: WO2017/170948

PCT Pub. Date: Oct. 5, 2017

(65) Prior Publication Data

US 2019/0106648 A1 Apr. 11, 2019

(30) Foreign Application Priority Data

Mar. 30, 2016 (JP) ..... JP2016-069741

(51) Int. Cl.

| | |
|---|---|
| ***C10M 141/10*** | (2006.01) |
| ***C10M 137/10*** | (2006.01) |
| ***C10M 139/00*** | (2006.01) |
| ***C10M 141/12*** | (2006.01) |
| ***C10M 129/54*** | (2006.01) |
| ***C10M 135/10*** | (2006.01) |
| ***C10M 135/18*** | (2006.01) |
| ***C10M 169/04*** | (2006.01) |
| ***C10N 30/04*** | (2006.01) |
| ***C10N 30/00*** | (2006.01) |
| ***C10N 40/02*** | (2006.01) |
| ***C10N 40/04*** | (2006.01) |
| ***C10N 40/25*** | (2006.01) |
| ***C10N 40/00*** | (2006.01) |

(52) U.S. Cl.

CPC ..... *C10M 141/10* (2013.01); *C10M 129/54* (2013.01); *C10M 135/10* (2013.01); *C10M 135/18* (2013.01); *C10M 137/10* (2013.01); *C10M 139/00* (2013.01); *C10M 141/12* (2013.01); *C10M 169/04* (2013.01); *C10M 2203/003* (2013.01); *C10M 2207/262* (2013.01); *C10M 2219/046* (2013.01); *C10M 2219/068* (2013.01); *C10M 2223/045* (2013.01); *C10N 2030/04* (2013.01); *C10N 2030/43* (2020.05); *C10N 2040/02* (2013.01); *C10N 2040/04* (2013.01); *C10N 2040/25* (2013.01); *C10N 2040/38* (2020.05)

(58) Field of Classification Search

CPC ..... C10M 141/10; C10M 141/12; C10M 139/00; C10M 169/04; C10M 135/18; C10M 135/10; C10M 129/54; C10M 137/10; C10M 2223/045; C10M 2219/068; C10M 2219/046; C10M 2207/262; C10M 2203/003; C10N 2240/52; C10N 2240/10; C10N 2240/04; C10N 2240/02; C10N 2230/43; C10N 2230/04

See application file for complete search history.

(56) References Cited

U.S. PATENT DOCUMENTS

| | | | | |
|---|---|---|---|---|
| 6,656,887 | B2 * | 12/2003 | Yagishita | C10M 137/06 508/371 |
| 7,458,585 | B2 * | 12/2008 | Hamada | C23C 28/048 277/442 |
| 2002/0142922 | A1 | 10/2002 | Yagishita et al. | |
| 2010/0093578 | A1 * | 4/2010 | Tsujimoto | C10M 167/00 508/430 |
| 2010/0147238 | A1 * | 6/2010 | Kurihara | C10M 169/04 123/1 A |
| 2012/0172266 | A1 * | 7/2012 | Kasai | C10M 163/00 508/185 |
| 2013/0129264 | A1 * | 5/2013 | Watanabe | C10M 135/02 384/13 |
| 2013/0167431 | A1 * | 7/2013 | West | C10L 1/19 44/400 |
| 2014/0274826 | A1 | 9/2014 | Maurin-Perrier et al. | |

FOREIGN PATENT DOCUMENTS

| | | | |
|---|---|---|---|
| CN | 1427069 | | 7/2003 |
| CN | 103003402 | | 3/2013 |
| JP | 2010-47667 | A | 3/2010 |
| JP | 2011-12213 | A | 1/2011 |
| JP | 2011-63654 | A | 3/2011 |
| JP | 2011-252073 | A | 12/2011 |
| JP | 2013-18873 | A | 1/2013 |
| JP | 2013-113430 | A | 6/2013 |
| JP | 2014-532841 | A | 12/2014 |

OTHER PUBLICATIONS

Japanese Office Action dated Oct. 1, 2019 in Patent Application No. 2016-069741 (with unedited computer generated English translation).

(Continued)

*Primary Examiner* — Pamela H Weiss

(74) *Attorney, Agent, or Firm* — Oblon, McClelland, Maier & Neustadt, L.L.P.

(57) ABSTRACT

The present in relates to a lubricating oil composition for sliding member having a coating film, the lubricating oil composition containing a base oil; (A) a zinc dialkyldithiophosphate; and (B) a metallic detergent, wherein the content of sulfur atom (S) is 2,800 ppm by mass or less on the basis of the whole amount of the lubricating oil composition, and a mass ratio of the content of sulfur atom (S) and the content of metal atom (BM) derived from the component (B) [(S)/(BM)] in the lubricating oil composition is 0.07 or more and 2.90 or less.

3 Claims, No Drawings

(56) References Cited

OTHER PUBLICATIONS

International Search Report dated May 1, 2017, in PCT/JP2017/013426 filed Mar. 30, 2017.
Japanese Office Action dated Jun. 9, 2020 in Japanese Patent Application No. 2016-069741 (with unedited computer generated English translation), 5 pages.
Office Action dated Apr. 2, 2021, China Patent Application No. 201780020489.0 (with English-language Translation). (references AA, AO and AP are cited therein).

* cited by examiner

LUBRICANT COMPOSITION

TECHNICAL FIELD

The present invention relates to a lubricating oil composition.

BACKGROUND ART

At present, the environment is regulated more and more severely on a global scale, and particularly in situations surrounding automobiles, regulations to fuel consumption, exhaust gases, and the like are becoming severer and severer. The above situations are backgrounded by environmental problems, such as global warming, and resource protection originating in concerns about depletion of oil resources. It is estimated that saving of fuel consumption in automobiles shall be advanced more and more because of the reasons described above. In respect to saving of fuel consumption in automobiles, important is an improvement in engine oils, such as a reduction in a viscosity of engine oils and addition of good friction modifiers, for preventing a frictional loss in engines in addition to an improvement in automobiles themselves, such as a reduction in a weight of cars and an improvement in engines. However, a reduction in a viscosity of engine oils is a cause to bring about an increase in friction in the respective parts of an engine, and therefore, a friction modifier, an extreme pressure agent, and the like are more and more important in order to reduce a frictional loss caused by the above reduction in a viscosity and prevent wear.

In addition, in order to reduce wear of an engine member, it is achieved to perform coating on the surfaces of sliding members, such as piston rings and cylinder liners.

A lubricating oil composition having a much more excellent friction-reducing effect against such a coated sliding member is also required.

PTL 1 discloses a lubricating oil composition containing a friction reducing agent, which is characterized by containing a specified amino compound and discloses a low-friction sliding member which is characterized by having a diamond-like carbon film on at least a part of the sliding surface of a sliding part and using the foregoing lubricating oil composition on the sliding surface.

CITATION LIST

Patent Literature

PTL 1: JP 2013-18873 A

SUMMARY OF INVENTION

Technical Problem

Hitherto, an aptitude of a lubricating oil composition for a sliding member having a coating, such as vanadium carbide and chromium nitride, has not been substantially verified. In addition, as for the sliding member having the foregoing coating, though the wear resistance of the sliding member per se is improved, for example, in the case where a member per se coming into contact with the sliding member having the foregoing coating is not coated, there is a concern that wear on the side of the member not having a coating is liable to advance.

As mentioned above, the aptitude of a lubricating oil composition for the sliding member having a coating film, such as vanadium carbide and chromium nitride (hereinafter also referred to as "coated sliding member") has not been substantially verified. In addition, a lubricating oil composition which is suitably used for a coated sliding member while taking into consideration the case where a sliding member coming into contact with a coated sliding member is a sliding member not having a coating is demanded.

In view of the foregoing circumstances, the present invention has been made. A problem of the present invention is to provide a lubricating oil composition which is able to not only reduce a temperature rise of a sliding member to be caused due to friction but also reduce wear of a sliding member having a coating film and a sliding member coming into contact with the foregoing sliding member.

Solution to Problem

The present inventors made extensive and intensive investigations. As a result, it has been found that the aforementioned problem can be solved by a lubricating oil composition containing a base oil, a zinc dialkyldithiophosphate, and a metallic detergent, wherein the content of sulfur atom in the lubricating oil composition is controlled to a specified value or less, and a ratio of the content of sulfur atom and the content of metal atom derived from the metallic detergent is satisfied with a specified range. The present invention has been accomplished on the basis of such findings. Specifically, in accordance with the present invention, the following [1] and [2] are provided.

[1] A lubricating oil composition for sliding member having a coating film, the lubricating oil composition containing:

a base oil;

(A) a zinc dialkyldithiophosphate; and (B) a metallic detergent, wherein the content of sulfur atom (S) is 2,800 ppm by mass or less on the basis of the whole amount of the lubricating oil composition, and a mass ratio of the content of sulfur atom (S) and the content of metal atom (BM) derived from the component (B) [(S)/(BM)] in the lubricating oil composition is 0.07 or more and 2.90 or less.

[2] A lubrication method including using the lubricating oil composition as set forth in the above [1] for a lubricating member having a coating film.

Advantageous Effects of Invention

In accordance with the present invention, it is possible to provide a lubricating oil composition which is able to not only reduce a temperature rise of a sliding member to be caused due to friction but also reduce wear of a sliding member having a coating film and a sliding member coming into contact with the foregoing sliding member.

DESCRIPTION OF EMBODIMENTS

Preferred embodiments of the present invention are hereunder described in detail.

[Lubricating Oil Composition]

The lubricating oil composition that is one embodiment of the present invention is a lubricating oil composition for sliding member having a coating film (hereinafter also referred to simply as "lubricating oil composition"), the lubricating oil composition containing a base oil; (A) a zinc dialkyldithiophosphate; and (B) a metallic detergent, wherein the content of sulfur atom (S) is 2,800 ppm by mass or less on the basis of the whole amount of the lubricating oil composition, and a mass ratio of the content of sulfur atom (S) and the content of metal atom (BM) derived from the component (B) [(S)/(BM)] in the lubricating oil composition is 0.07 or more and 2.90 or less.

In view of the fact that the foregoing lubricating oil composition contains zinc dialkyldithiophosphate that is an anti-wear agent and (B) a metallic detergent in such a manner that a mass ratio of the content of sulfur atom (S) and the content of metal atom (BM) derived from the metallic detergent (B) is satisfied with a specified range, the lubricating oil composition makes it possible to not only reduce a temperature rise of a sliding member to be caused clue to wear but also reduce friction of a coated sliding member and a sliding member coming into contact with the foregoing sliding member.

When the content of sulfur atom (S) in the lubricating oil composition is more than 2,800 ppm by mass on the basis of the whole amount of the lubricating oil composition, the lubricating oil composition is inferior in the effect for reducing a temperature rise of a sliding member to be caused due to friction, and it becomes difficult to reduce wear of a coated sliding member and a sliding member coming into contact with the foregoing sliding member. From such viewpoints, the content of sulfur atom (S) is preferably 2,700 ppm by mass or less, more preferably 2,600 ppm by mass or less, and still more preferably 2,500 ppm or less on the basis of the whole amount of the lubricating oil composition. In addition, though a lower limit value thereof is not particularly limited, in view of the fact that the lubricating oil composition contains a sulfur atom derived from the component (A), the content of sulfur atom (S) is at least more than 0 ppm by mass, preferably 100 ppm by mass or more, more preferably 300 ppm by mass or more, and still more preferably 500 ppm by mass or more on the basis of the whole amount of the lubricating oil composition.

When the mass ratio of the content of sulfur atom (S) and the content of metal atom (BM) derived from the component (B) [(S)/(BM)] in the lubricating oil composition is more than 2.90, the lubricating oil composition is inferior in the effect for reducing a temperature rise of a sliding member to be caused due to friction, and it becomes difficult to reduce wear of a coated sliding member and a sliding member coming into contact with the foregoing sliding member. From such viewpoints, the mass ratio [(S)/(BM)] is preferably 2.80 or less, more preferably 2.70 or less, and still more preferably 2.60 or less.

From the viewpoint of not only reducing a temperature rise of a sliding member to be caused due to friction but also reducing wear of a coated sliding member and a sliding member coming, into contact with the foregoing sliding member, a lower limit value of the mass ratio [(S)/(BM)] is 0.07 or more, preferably 0.10 or more, still more preferably 0.20 or more, and yet still more preferably 0.30 or more.

When the lubricating oil composition is satisfied, with both the aforementioned content of sulfur atom (S) and the aforementioned mass ratio [(S)/(BM)], it is possible to not only reduce a temperature rise of a sliding member to be caused due to friction but also reduce wear of a coated sliding member and a sliding member coming into contact with the foregoing sliding member.

Here, the coating film may be a coating film to be provided on a member for the purpose of reducing the wear as mentioned above, and for example, there is exemplified at least one selected from the group consisting of a chromium nitride film, a chromium carbide film, and a vanadium carbide film.

The sliding member refers to a member to be used in a sliding portion (part). For example, even in the case where only a one-sided member slides, and the other member comes into contact with or is also fixed in close vicinity to the foregoing sliding member, the foregoing other member is a member to be used in the sliding portion (part), and therefore, it is included in the sliding member.

The sliding member having a coating film may be used for any of a sliding member which performs the movement, for example, a rotation action, and a sliding member coming into contact with or being fixed in close vicinity to the foregoing sliding member, and all of them may be a coated sliding member, too.

In consequence, the aforementioned "sliding member coming into contact with the coated sliding member" may be either a coated sliding member or a non-coated sliding member. Here, since the both sliding members adjacent to each other are not always the same coating treated member, there is a case where in either one of the sliding members, the wear is more liable to advance due to factors, such as the composition of the coating, or the hardness or shape of the sliding member, as compared with the other sliding member. In this way, in the case where the one-sided sliding member is a non-coated sliding member, there is a possibility that wear of the foregoing sliding member is liable to advance. From the foregoing viewpoint, the lubricating oil composition that is one embodiment of the present invention can be more suitably used in the case where the sliding member coming into contact with the aforementioned coated sliding member is a non-coated sliding member.

In the lubricating oil composition, the sulfated ash content is preferably 1.70 mass % or less, more preferably 1.00 mass % or less, and still more preferably 0.95 mass % or less on the basis of the whole amount of the lubricating oil composition. The sulfated ash content is preferably 0.001 mass % or more, and more preferably 0.01 mass % or more on the basis of the whole amount of the lubricating oil composition.

The value of the sulfated ash content is a value as calculated by the method described in the section of Examples as mentioned later.

Each of the components that constitute the lubricating oil composition that is one embodiment of the present invention is hereunder described.

<Base Oil>

The base oil which is used in the lubricating oil composition is not particularly limited, and an arbitrary material among mineral oils or synthetic oils which have been conventionally used as a base oil of lubricating oil can be suitably selected and used.

Examples of the mineral oil include a mineral oil refined by subjecting a lubricating oil distillate that is obtained by distilling under reduced pressure an atmospheric residue given by atmospheric distillation of crude oil, to one or more treatments selected from solvent deasphalting, solvent extraction, hydro-cracking, solvent dewaxing, catalytic dewaxing, hydrorefining, and the like; a base oil produced by isomerizing a wax or GTL WAX (gas-to-liquid wax); and the like. Of those, a mineral oil treated by hydrorefining and a base oil produced by isomerizing GTL WAX are preferred. These base oils readily make a % $C_P$ and a viscosity index as mentioned later good.

Examples of the synthetic oil include poly-α-olefins, such as polybutene and an α-olefin homopolymer or copolymer (for example, an ethylene-α-olefin copolymer); various esters, such as a polyol ester, a dibasic acid ester, and a phosphate ester; various ethers, such as a polyphenyl ether; polyglycols; alkylbenzenes; and alkylnapthalenes. Of those synthetic oils, in particular, poly-α-olefins and polyol esters are preferred, and those obtained by combining two kinds thereof are also suitably used as the synthetic oil.

In one embodiment of the present invention, the aforementioned mineral oils may be used singly or may be used in combination of two or more thereof as the base oil. In addition, the aforementioned synthetic oils may be used alone or may be used in combination of two or more thereof. Furthermore, one or more of the mineral oils and one or more of the synthetic oils may be used in combination.

The content of the base oil is typically 65 mass % or more, preferably 70 mass % or more, and more preferably 75 mass % or more, and it is preferably 97 mass % or less, and more preferably 95 mass % or less, relative to the whole amount of the lubricating oil composition.

Although the base oil is not particularly limited with respect to the viscosity, a kinematic viscosity thereof at 100° C. is in the range of preferably 2 $mm^2/s$ or more and 30 $mm^2/s$ or less, more preferably 3 $mm^2/s$ or more and 15 $mm^2/s$ or less, and still more preferably 4 $mm^2/s$ or more and 10 $mm^2/s$ or less.

When the kinematic viscosity at 100° C. of the base oil is 2 $mm^2/s$ or more, an evaporation loss is small, and when it is 30 $mm^2/s$ or less, a power loss to be caused due to viscous resistance is suppressed, and a fuel consumption improving effect is obtained, and hence, such is preferred.

Although a kinematic viscosity at 40° C. of the base oil is not particularly limited, it is in the range of preferably 5 $mm^2/s$ or more and 65 $mm^2/s$ or less, more preferably 8 $mm^2/s$ or more and 40 $mm^2/s$ or less, and still more preferably 10 $mm^2/s$ or more and 25 $mm^2/s$ or less.

A viscosity index of the base oil is preferably 100 or more, more preferably 110 or more, still more preferably 120 or more, and yet still more preferably 130 or more. The base oil having a viscosity index of 100 or more is small in a change in viscosity due to a change in temperature. When the viscosity index of the base oil falls within the foregoing range, it is easy to make the viscosity characteristics of the lubricating oil composition good.

The value of the kinematic viscosity at 100° C., the value of the kinematic viscosity at 40° C., and the viscosity index are values, respectively as measured by the methods described, in the section of Examples as mentioned later.

As the base oil, one having an aromatic content (% $C_A$) by ring analysis of 3.0 or less and the content of sulfur component of 50 ppm by mass or less is preferably used. The term "% $C_A$ by ring analysis" refers to a proportion (percentage) or aromatic components calculated by the ring analysis n-d-M method.

The base oil having a % $C_A$ of 3.0 or less and the content of sulfur of 50 ppm by mass or less is preferred because it has good oxidation stability and is able to provide a lubricating oil composition capable of suppressing an increase of acid number or the generation of sludge. The % $C_A$ is more preferably 1.0 or less, and still more preferably 0.5 or less, and the content of sulfur is more preferably 30 ppm by mass or less, still more preferably 10 ppm by mass or less, and yet still more preferably 2 ppm by mass or less.

The base oil has a paraffin content (% $C_P$) as measured by ring analysis of preferably 75 or more, more preferably 80 or more, and still more preferably 85 or more. When the % $C_P$ is 75 or more, the oxidation stability of the base oil becomes good. Here, the term "% $C_P$ by ring analysis" refers to a proportion (percentage) of paraffin components calculated by the ring analysis n-d-M method.

A NOACK value of the base oil is preferably 15.0 mass % or less, and more preferably 14.0 mass % or less.

The value of the % $C_A$, the value of the % $C_P$, the value of the content of sulfur, and the NOACK value are values, respectively as measured by the methods described in the section of Examples as mentioned later.

<(A) Zinc Dialkyldithiophosphate>

The lubricating oil composition contains (A) a zinc dialkyldithiophosphate (hereinafter also referred to simply as "component (A)"). When the component (A) is contained, it is possible to provide a lubricating oil composition having an excellent effect for not only reducing a temperature rise of a sliding member to be caused due to friction but also reducing wear of a coated sliding member and a sliding member coming into contact with the foregoing sliding member.

Although the component (A) which is used in the lubricating oil composition is not particularly limited, it is preferably a compound represented by the following general formula (I).

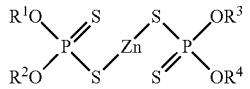

(I)

In the general formula (I), $R^1$, $R^2$, $R^3$, and $R^4$ each independently represent a hydrocarbyl group.

The hydrocarbyl group is preferably a hydrocarbyl group having a carbon number of 1 or more and 24 or less.

The hydrocarbyl group is a monovalent substituent formed by removing one hydrogen atom from a hydrocarbon. As such a substituent, the following are exemplified.

1. Hydrocarbon Substituent

Examples of the hydrocarbon substituent include aliphatic substituents, such as an alkyl group and an alkenyl group; alicyclic substituents, such as a cycloalkyl group and a cycloalkenyl group; aromatic hydrocarbon groups (aromatic groups), such as a phenyl group; and these groups substituted with an aromatic group, an aliphatic group, or an alicyclic group.

2. Substituted Hydrocarbon Substituent

Examples of the substituted, hydrocarbon substituent include the aforementioned hydrocarbon substituents having a non-hydrocarbon group as the substituent. Examples of the non-hydrocarbon group include a halogen group, such as a chloro group and a fluoro group, an amino group, an alkoxy group, a mercapto group, an alkyl mercapto group, a nitro group, a nitroso group, and a sulfoxy group.

Examples of the hydrocarbyl group having a carbon number of 1 or more and 24 or less include a linear or branched alkyl group having a carbon number of 1 or more and 24 or less, a linear or branched alkenyl group having a carbon number of 3 or more and 24 or less, a cycloalkyl group or a linear or branched alkylcycloalkyl group having a carbon number of 5 or more and 13 or less, an aryl group or a linear or branched alkylaryl group having a carbon number of 6 or more and 18 or less, and an arylalkyl group having a carbon number of 7 or more and 19 or less. Of those, an alkyl group is preferred, and a primary or secondary alkyl group having a carbon number of 3 or more and 22 or less is more preferred.

The carbon number of the alkyl group is preferably 3 or more and 20 or less, more preferably 3 or more and 12 or less, and still more preferably 3 or more and 10 or less.

Examples of the primary or secondary alkyl group having a carbon number of 3 or more and 10 or less include a primary or secondary propyl group, a primary or secondary butyl group, a primary or secondary pentyl group, a primary or secondary hexyl group, a primary or secondary heptyl group, a primary or secondary octyl group, a primary or secondary nonyl group, and a primary or secondary decyl group.

These components (A) may be used alone or may be used in combination of two or more thereof.

Although the content of the component (A) is not particularly limited so long as it is satisfied with the content of sulfur atom (S) in the lubricating oil composition, it is preferably 0.05 mass % or more, more preferably 0.10 mass % or more, and still more preferably 0.40 mass % or more, and it is preferably 1.50 mass % or less, more preferably 1.30 mass % or less, and still more preferably 1.20 mass % or less, on the basis of the whole amount of the lubricating oil composition.

A preferred range of the total content in the case where two or more of the component (A) are combined is the same as the preferred range in the case where the component (A) is used alone.

<(B) Metallic Detergent>

The lubricating oil composition contains (B) a metallic detergent (hereinafter also referred to simply as "component (B)"). When the component (B) is contained, it is possible to provide a lubricating oil composition having an excellent effect for not only reducing a temperature rise of a sliding member to be caused due to friction but also reducing wear of a coated sliding member and a sliding member coming into contact with the foregoing sliding member.

Examples of the component (B) include an alkali metal-based detergent and an alkaline earth metal-based detergent. Specifically, there is exemplified at least one metallic detergent selected from the group consisting of an alkali metal sulfonate, an alkaline earth metal sulfonate, an alkali metal phenate, an alkaline earth metal phenate, an alkali metal salicylate, and an alkaline earth metal salicylate. In addition, examples of the alkali metal include sodium and potassium, and examples of the alkaline earth metal include magnesium, calcium, and barium. Of those metals included in the component (B), an embodiment of at least one selected from the group consisting of calcium, magnesium, and sodium is preferred, and an embodiment of at least one selected from calcium alone, calcium and magnesium, and calcium and sodium is more preferred. That is, it is preferred that the lubricating oil composition contains a calcium-based detergent as the component (B).

As the alkali metal sulfonate or alkaline earth metal sulfonate, there is exemplified an alkali metal salt or alkaline earth metal salt of an alkyl aromatic sulfonic acid obtained through sulfenation of an alkyl aromatic compound having a weight average molecular weight of preferably 300 or more and 1,500 or less, and more preferably 400 or more and 700 or less.

Examples of the alkali metal phenate or alkaline earth metal phenate include alkali metal salts or alkaline earth metal salts of an alkylphenol, an alkylphenyl sulfide, or a Mannich reaction product of an alkylphenol.

Examples of the alkali metal salicylate or alkaline earth metal salicylate include alkali metal salts or alkaline earth metal salts of an alkyl salicylic acid.

The alkyl group that constitutes the alkali metal-based detergent or alkaline earth metal-based detergent is an alkyl group having a carbon number of preferably 4 or more and 30 or less, and more preferably 6 or more and 24 or less. Such an alkyl group may be either linear or branched. In addition, the alkyl group may be a primary alkyl group, a secondary alkyl group, or a tertiary alkyl group.

The component (B) includes neutral or basic alkali metal-based detergents (base number: 0 to 50 mgKOH/g), such as a neutral or basic alkali metal sulfonate or neutral or basic alkaline earth metal sulfonate, a neutral or basic alkali metal phenate or neutral or basic alkaline earth metal phenate, and a neutral or basic alkali metal salicylate or neutral or basic alkaline earth metal salicylate; and overbased metallic detergents (base number: 50 to 500 mgKOH/g), such as an overbased alkali metal sulfonate or overbased alkaline earth metal sulfonate, an overbased alkali metal phenate or overbased alkaline earth metal phenate, and an overbased alkali metal salicylate or overbased alkaline earth metal salicylate.

Of those, the neutral metallic detergent has a cleaning action that is a main function of the detergent. The overbased metallic detergent is more excellent than the neutral metallic detergent with respect to an acid-neutralization ability of neutralizing an acid, such as an organic acid generated in the lubricating oil due to oxidative degradation and nitric acid generated due to combustion.

The base number of the metallic detergent which is used in the present invention means a base number by the potentiometric titration method (base number/perchlorate method) as measured in conformity with JIS K2501: "Petroleum Products and Lubricants—Neutralization Number Testing Method".

The component (B) is preferably an overbased metallic detergent, such as an overbased alkali metal-based detergent or an overbased alkaline earth metal-based detergent, e.g., an overbased alkali metal sulfonate overbased alkaline earth metal sulfonate, an overbased alkali metal phenate or overbased alkaline earth metal phenate, and an overbased alkali metal salicylate or overbased alkaline earth metal salicylate. Of those overbased metallic detergents, an embodiment of at least one selected from the group consisting of an overbased calcium salicylate, an overbased magnesium sulfonate, and an overbased sodium sulfonate is preferred, and an embodiment of at least one selected from an overbased calcium salicylate alone, an overbased calcium salicylate and an overbased magnesium sulfonate, and overbased calcium salicylate and an overbased sodium sulfonate is more preferred. That is, it is preferred that the lubricating oil composition contains an overbased calcium salicylate as the component (B).

These metallic detergents may be used, alone or may be used in combination of two or more thereof.

The base number in the case of using the overbased metallic detergent is preferably 200 mgKOH/g or more, and more preferably 300 mgKOH/g or more, and it is preferably 500 mgKOH/g or less, and more preferably 450 mgKOH/g or less.

The content of the component (B) can be converted as the content of metal atom (BM) derived from the component (B), and as mentioned above, the content of the component (B) is not particularly limited so long as the aforementioned mass ratio [(S)/(BM)] is satisfied. However, from the viewpoint of reducing wear of a coated sliding member and a sliding member coming into contact with the foregoing sliding member, the content of metal atom (BM) derived from the component (B) is preferably 800 ppm by mass or more, more preferably 900 ppm, by mass or more, and still more preferably 1,000 ppm by mass or more on the basis of the whole amount of the lubricating oil composition. In addition, from the viewpoint of reducing the sulfated ash content, the content of metal atom (BM) is preferably 4,500 ppm by mass or less, more preferably 2,500 ppm by mass or less, and still more preferably 2,100 ppm by mass or less on the basis of the whole amount of the lubricating oil composition.

A preferred range of the total content in the case where two or more of the components (B) are combined is the same as the preferred range in the case where the component (B) is used alone.

<(C) Molybdenum-Based Friction Modifier>

It is preferred that the lubricating oil composition further contains (C) molybdenum-based friction modifier (hereinafter also referred to as simply as "component (C)"), with a mass ratio of the content of molybdenum atom (Mo) derived from the component (C) and the content of metal atom (BM) derived from the component (B) [(Mo)/(BM)] being 0.05 or more and 1.00 or less.

When the component (C) is contained and the foregoing mass ratio [(Mo)/(BM)] is satisfied, it is possible to provide a lubricating oil composition having an excellent effect for not only more reducing a temperature rise of a sliding member to be caused due to friction but also more reducing wear of a coated sliding member and a sliding member coming into contact with the foregoing sliding member.

From such viewpoints as well as the viewpoint of suppressing discoloration of the coated sliding member, the mass ratio [(Mo)/(BM)] is preferably 0.10 or more, more preferably 0.30 or more, and still more preferably 0.50 or more. In addition, from the viewpoint of suppressing precipitation of molybdenum in the lubricating oil composition, the mass ratio [(Mo)/(BM)] is preferably 0.95 or less, more preferably 0.90 or less, and still more preferably 0.85 or less.

The content of the component (C) can be converted as the content of molybdenum atom (Mo) derived from the component (C), and as mentioned above, the range satisfying the aforementioned mass ratio [(Mo/(BM)] is preferred. From the viewpoint of not only more reducing a temperature rise of a sliding member to be caused due to friction but also more reducing wear of a coated sliding member and a sliding member coming into contact with the foregoing sliding member, the content of molybdenum atom (Mo) derived from the component (C) is preferably 200 ppm by mass or more, and more preferably 250 ppm by mass or more on the basis of the whole amount of the lubricating oil composition. Furthermore, in addition to these viewpoints, from the viewpoint of suppressing discoloration of the coated sliding member, the content of molybdenum atom (Mo) derived from the component (C) is still more preferably 300 ppm by mass, or more, yet still more preferably 500 ppm by mass or more, and even yet still more preferably 700 ppm by mass or more.

From the viewpoint of suppressing precipitation of molybdenum in the lubricating oil composition, the content of molybdenum atom (Mo) derived from the component (C) is preferably 950 ppm by mass or less, more preferably 900 ppm by mass or less, still more preferably 850 ppm by mass or less.

The component (C) preferably includes at least one selected from the group consisting of a molybdenum dithiocarbamate (MoDTC) (C1) and a molybdenum dithiophosphate (MoDTP) (C2) as mentioned below.

Examples of the molybdenum dithiocarbamate (C1) include a binuclear molybdenum dithiocarbamate (C11) having two molybdenum atoms in one molecule thereof; and a trinuclear molybdenum dithiocarbamate (C12) having three molybdenum atoms in one molecule thereof.

The molybdenum dithiocarbamate (C1) may be used either alone or in combination of two or more thereof.

As the binuclear molybdenum dithiocarbamate (C11), a compound represented by the following general formula (c11-1) and/or a compound represented by the following general formula (c11-2) is preferred.

(c11-1)

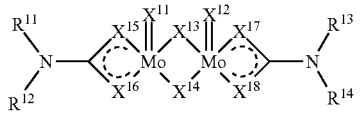

(c11-2)

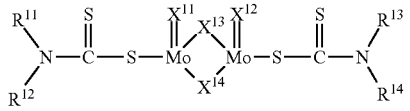

In the general formulae (c11-1) and (c11-2), $R^{11}$ to $R^{14}$ each independently represent a hydrocarbon group, and may be the same as or different from each other.

$X^{11}$ to $X^{18}$ each independently represent an oxygen atom or a sulfur atom, and may be the same as or different from each other provided that at least two of $X^{11}$ to $X^{18}$ in the general formula (c11-1) are a sulfur atom.

In the case of using the general formula (c11-2) as the component (C), it is preferred that $X^{11}$ to $X^{14}$ in the general formula (c11-2) are an oxygen atom.

In the general formula (c11-1), from the viewpoint of improving solubility in the base oil, a molar ratio of a sulfur atom to an oxygen atom [sulfur atom/oxygen atom] in $X^{11}$ to $X^{18}$ is preferably 1/4 or more and 4/1 or less, and more preferably 1/3 or more and 3/1 or less.

In the general formula (c11-2), from the same viewpoint as that mentioned above, a molar ratio of a sulfur atom to an oxygen atom [sulfur atom/oxygen atom] in $X^{11}$ to $X^{14}$ is preferably 1/3 or more and 3/1 or less, and more preferably 1.5/2.5 or more and 2.5/1.5 or less.

The carbon number of the hydrocarbon group which may be selected as $R^{11}$ to $R^{14}$ is preferably 7 or more and 22 or less, more preferably 7 or more and 18 or less, still more preferably 7 or more and 14 or less, and yet still more preferably 8 or more and 13 or less.

Examples of the hydrocarbon group which nay be selected as $R^{11}$ to $R^{14}$ in the general formulae (c11-1) and (c11-2) include an alkyl group, such as a methyl group, an ethyl group, a propyl group, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, and an octadecyl group; an alkenyl group, such as an octenyl group, a nonenyl group, a decenyl group, an undecenyl group, a dodecenyl group, a tridecenyl group, a tetradecenyl group, and a pentadecenyl group; a cycloalkyl group, such as a cyclohexyl group, a dimethylcyclohexyl group, an ethylcyclohexyl group, a methylcyclohexylmethyl group, a cyclohexylethyl group, a propylcyclohexyl group, a butylcyclohexyl group, and a heptylcyclohexyl group; an aryl group, such as a phenyl group, a naphthyl group, an anthracenyl group, a biphenyl group, and a terphenyl group; an alkylaryl group, such as a tolyl group, a dimethylphenyl group, a butylphenyl group, a nonylphenyl group, a methylbenzyl group, and a dimethylnaphthyl group; and an arylalkyl group, such as a phenylmethyl group, a phenylethyl group, and a diphenylmethyl group.

As the trinuclear molybdenum dithiocarbamate (C12), a compound represented by the following general formula (c12-1) is preferred.

$$Mo_3S_kE_mL_nU_pQ_z \quad \text{(c12-1)}$$

In the general formula (c12-1), k is an integer of 1 or more; m is an integer of 0 or more; and (k+m) is an integer of 4 or more and 10 or less, and preferably an integer of 4 or more and 7 or less. n is an integer of 1 or more and 4 or less; and p is an integer of 0 or more. z is an integer of 0 or more and 5 or less, inclusive of a non-stoichiometric value.

Mo is a molybdenum atom, and S is a sulfur atom.

E's are each independently an oxygen atom or a selenium atom, and for example, are one capable of substituting sulfur in a core as mentioned later.

L's are each independently an anionic ligand having a carbon atom-containing organic group; a sum total of carbon atoms of the organic group in each of the ligands is 14 or more; and the respective ligands may be the same as or different from each other.

U's are each independently an anion other than L.

Q's are each independently a compound capable of providing a neutral electron and are existent for the purpose of fulfilling a vacant coordination site on the trinuclear molybdenum compound.

A sum total of carbon atoms of the organic group in the anionic ligand(s) represented by L is preferably 14 or more and 50 or less, more preferably 16 or more and 30 or less, and still more preferably 18 or more and 24 or less.

As L, a monoanionic ligand that is a monovalent anionic ligand is preferred, and specifically, ligands represented by the following general formulae (i) to (iv) are more preferred.

In the general formula (c12-1), the anionic ligand which is selected as L is preferably a ligand represented by the following general formula (iv).

In the general formula (c12-1), it is preferred that all of the anionic ligands which are selected as L are the same, and it is more preferred that all of the anionic ligands selected as L are a ligand represented by the following general formula (iv).

(i)

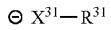

(ii)

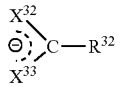

(iii)

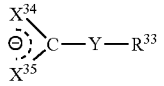

(iv)

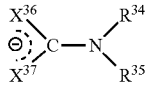

In the general formulae (i) to (iv), $X^{31}$ to $X^{37}$ and Y are each independently an oxygen atom or a sulfur atom, and may be the same as or different from each other.

In the general formulae (i) to (iv), to $R^{31}$ to $R^{35}$ are each independently an organic group, and may be the same as or different from each other.

The carbon number of each of the organic groups which may be selected as $R^{31}$, $R^{32}$, and $R^{33}$ is preferably 14 or more and 50 or less, more preferably 16 or more and 30 or less, and still more preferably 18 or more and 24 or less.

The total carbon number of the two organic groups which may be selected as $R^{34}$ and $R^{35}$ in the general formula (iv) is preferably 14 or more and 50 or less, more preferably 16 or more and 30 or less, and still more preferably 18 or more and 24 or less.

The carbon number of each of the organic groups which may be selected as $R^{34}$ and $R^{35}$ is preferably 7 or more and 30 or less, more preferably 7 or more and 20 or less, and still more preferably 8 or more and 13 or less.

Although the organic group of $R^{34}$ and the organic group of $R^{35}$ may be the same as or different from each other, they are preferably different from each other. In addition, though the carbon number of the organic group of $R^{34}$ and the carbon number of the organic group of $R^{35}$ may be the same as or different from each other, they are preferably different from each other.

Examples of the organic group which is selected as $R^{31}$ to $R^{35}$ include a hydrocarbyl group, such as an alkyl group, an aryl group, and a substituted aryl group, and an alkoxy group.

The hydrocarbyl group is the same as that mentioned above for the description of the component (A). In addition, the hydrocarbyl groups that are the organic group which is selected as $R^{31}$ to $R^{35}$ may be each independently bonded to at least one selected from other hydrocarbyl groups to form a ring.

In the general formula (c12-1), as the anionic ligand which is selected as L, ligands derived from an alkylxanthogenate, a carboxylate, a dialkyldithiocarbamate, or a mixture thereof are preferred, and ligands derived from a dialkyldithiocarbamate are more preferred.

In the general formula (c12-1), the anion which may be selected as U may be either a monovalent anion or a divalent anion, and examples of the anion which may be selected as U include a disulfide, a hydroxide, an alkoxide, an amide, a thiocyanate, and derivatives thereof.

In the general formula (c12-1), examples of include water, an amine, an alcohol, an ether, and a phosphine. Although Qs may be the same as or different from each other they are preferably the same as each other.

As the trinuclear molybdenum dithiocarbamate (C12), among the compounds represented by the general formula (c12-1), a compound in which k is an integer of 4 or more and 7 or less; n is 1 or 2; L is a monoanionic ligand; p is an integer of imparting electrical neutrality to the compound based on an anionic charge in U; and m and n are each 0 is preferred; and a compound in which k is an integer of 4 or more and 7 or less; L is a monoanionic ligand; n is 4; and p, m, and z are each 0 is more preferred.

As the trinuclear molybdenum dithiocarbamate (C12), for example, a compound having a core represented by the following formula (II) or (III) is preferred. Each core has a net electrical charge of +4. Such a core is surrounded by an anionic ligand and an optionally existing anion other than the anionic ligand.

(II)

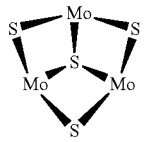

-continued (III)

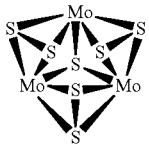

Formation of the trinuclear molybdenum-sulfur compound requires selection of an appropriate anionic ligand (L) and other anion (U), depending on, for example, the number of sulfur and E atoms present in the core, i.e., the total anionic charge constituted of a sulfur atom, an E atom, if present, L, and U, if present, must be −4.

In the case where the anionic charge exceeds −4, the trinuclear molybdenum-sulfur compound may also contain a cation other than molybdenum, for example, an (alkyl) ammonium, an amine, or sodium. A preferred embodiment of the anionic ligand (L) and other anion (U) is a constitution having four monoanionic ligands.

The molybdenum-sulfur cores, for example, the structures represented by the aforementioned formulae (II) and (III), may be interconnected by means of one or more multidentate ligands, i.e., a ligand having more than one functional group capable of binding to a molybdenum atom to form oligomers.

As the molybdenum dithiophosphate (C2), a compound represented by the following general formula (c2-1) and/or a compound represented by the following general formula (c2-2) is preferred.

In the present invention, the molybdenum dithiophosphate (C2) may be used either, alone or in combination of two or more thereof.

(c2-1)

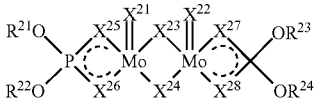

(c2-2)

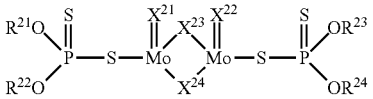

In the general formulae (c2-1) and (c2-2), $R^{21}$ to $R^{24}$ each independently represent a hydrocarbon group, and may be the same as or different from each other.

$X^{21}$ to $X^{28}$ each independently represent an oxygen atom or a sulfur atom, and may be the same as or different from each other, provided that at least two of $X^{21}$ to $X^{28}$ in the formula (c2-1) are a sulfur atom.

In the general formula (c2-1), from the viewpoint of improving solubility in the base oil, a molar ratio of a sulfur atom to an oxygen atom [sulfur atom/oxygen atom] in $X^{21}$ to $X^{28}$ is preferably 1/4 or more and 4/1 or less, and more preferably 1/3 or more and 3/1 or less.

In the general formula (c2-2), from the same viewpoint, a molar ratio of a sulfur atom to an oxygen atom [sulfur atom/oxygen atom] in $X^{21}$ to $X^{24}$ is preferably 1/3 or more and 3/1 or less, and more preferably 1.5/2.5 or more and 2.5/1.5 or less.

The carbon number of the hydrocarbon group which may be selected as $R^{21}$ to $R^{24}$ is preferably 1 or more and 20 or less, more preferably 5 or more and 18 or less, still more preferably 5 or more and 16 or less, and yet still more preferably 5 or more and 12 or less.

Examples of the hydrocarbon group which may be selected as $R^{21}$ to $R^{24}$ in the general formulae (c2-1) and (c2-2) include the same hydrocarbon groups as those mentioned above, which may be selected as $R^{11}$ to $R^{14}$ in the general formula (c11-1) or (c11-2).

The lubricating oil composition that is one embodiment of the present invention may contain a molybdenum-based compound (C3) other than the molybdenum dithiocarbamate (C1) and the molybdenum dithiophosphate (C2) within a range where the effects of the present invention are not impaired.

Examples of such other molybdenum-based compound (C3) include an amine salt of molybdic acid; and a molybdenum amine complex obtained through a reaction of molybdenum trioxide and/or molybdic acid and an amine compound.

The component (C) may be used either alone or in combination of two or more thereof. One compound or a combination of two or more compounds selected from the group consisting of the respective compound represented by the foregoing respective general formulae may be used. A preferred range of the total content in the case where two or more of the components (C) are combined is the same as the preferred range in the case where the component (C) is used alone.

<Other Components>

In the lubricating oil composition, if desired, other additives, for example, a viscosity index improver, a detergent dispersant other than the component (B) (hereinafter also referred to simply as "other detergent dispersant"), an antioxidant, a friction modifier other than the component (A) and the component (C) (hereinafter also referred to simply as "other friction modifier"), an anti-wear agent, an extreme pressure agent, a metal deactivator, a pour-point depressant, an anti-foaming agent, a surfactant or a demulsifier, and a rust inhibitor, may be suitably contained within a range where the object of the present invention is not impaired.

Examples of the viscosity index improver include a polymethacrylate (PMA)-based viscosity index improver (for example, a polyalkyl methacrylate and a polyalkyl acrylate), an olefinic copolymer (OCP)-based viscosity index improver (for example, an ethylene-propylene copolymer (EPC) and a polybutylene), and a styrenic copolymer (for example, a polyalkylstyrene, a styrene-diene copolymer, a styrene-diene hydrogenated copolymer, and a styrene-maleic anhydride ester copolymer). Examples of the PMA-based viscosity index improver include a dispersion type and a non-dispersion type. The dispersion type PMA-based viscosity index improver is a homopolymer of alkyl methacrylate or alkyl acrylate; and the non-dispersion type PMA-based viscosity index improver is a copolymer of an alkyl methacrylate or alkyl acrylate and a polar monomer having dispersion properties (for example, diethylaminoethyl methacrylate). In addition, similar to the PMA-based viscosity index improver, the OCP-based viscosity index improver includes a dispersion type, too. In such a viscosity index improver, its weight average molecular weight (Mw) is preferably 5,000 or more and 1,500,000 or less. In the case of the PMA-based viscosity index improver, the weight average molecular weight (Mw) is preferably 20,000 or more, and more preferably 100,000 or more, and it is preferably 1,000,000 or less, and more preferably 800,000 or less. In addition, in the case of the OCP-based viscosity index improver, the weight average molecular weight (Mw)

is preferably 10,000 or more, and more preferably 20,000 or more, and it is preferably 800,000 or less, and more preferably 500,000 or less.

The weight average molecular weight (Mw) is measured by the method described in the section of Examples as mentioned later.

The structure of the viscosity index improver may be either linear or branched. In addition, the viscosity index improver may be a polymer having a specified structure, such as a comb-type polymer having a structure having a large number of trigeminal branch points from which a high-molecular weight side chain comes out in a main chain thereof; and a star-shaped polymer which is a kind of branched polymer and has a structure in which three or more chain polymers are bonded at one point.

The viscosity index improver is preferably a polyalkyl (meth)acrylate having SSI of 35 or less. Here, the SSI means a shear stability index and expresses ability to resist decomposition of the polymer (polyalkyl (meth)acrylate). As the SSI is larger, the polymer is more instable against shearing and is more likely decomposed. The SSI expresses a percentage of viscosity decrease to be caused due to shearing originated from the polymer and is calculated according to the following calculation formula.

$$SSI = \frac{Kv_0 - Kv_1}{Kv_0 - Kv_{oil}} \times 100 \quad \text{[Math. 1]}$$

In the calculation formula, $Kv_0$ represents a value of kinematic viscosity at 100° C. of a sample oil obtained by diluting the polyalkyl (meth)acrylate in a mineral oil. $Kv_1$ represents a value of kinematic viscosity at 100° C. after passing a sample oil obtained by diluting the viscosity index improver containing the foregoing resin component in a mineral oil through a high-shear Bosch diesel injector for 30 cycles according to the procedures of ASTM D6278. In addition, $Kv_{oil}$ denotes a value of kinematic viscosity at 100° C. of the mineral oil used on the occasion of diluting the viscosity index improver.

By using the polyalkyl (meth)acrylate having an SSI of 35 or less, wear prevention properties of the lubricating oil composition can be enhanced. The SSI is more preferably 1 to 35.

The monomer that constitutes the aforementioned polyalkyl (meth)acrylate is an alkyl (meth)acrylate, and preferably an alkyl (meth)acrylate of a linear alkyl group having a carbon number of 1 or more and 18 or less or a branched alkyl group having a carbon number of 3 or more and 34 or less.

Although the viscosity index improver contains, as the resin component, for example, the aforementioned polymer, in general, it is frequently marketed in a state in which the resin component containing the polymer is diluted with a diluent oil, such as a mineral oil, while taking into consideration handling properties or solubility in the aforementioned base oil. A concentration of the resin component of the viscosity index improver is typically 10 mass % or more and 50 mass % or less on the basis of the whole amount of the viscosity index improver.

These viscosity index improvers can be contained either alone or in arbitrary combination of two or more thereof. The content of the viscosity index improver as expressed in terms of the resin component is preferably 0.01 mass % or more, more preferably 0.10 mass % or more, and still more preferably 0.20 mass % or more, and it is preferably 2.00 mass % or less, more preferably 1.50 mass % or less, and still more preferably 1.00 mass % or less, on the basis of the whole amount of the lubricating oil composition.

As other detergent dispersant, an ashless dispersant can be used.

As the ashless dispersant, an arbitrary ashless dispersant which is used for a lubricating oil can be used. Examples thereof include a mono-type succinimide compound represented by the following general formula (VI-i) or a bis-type succinimide compound represented by the following general formula (VI-ii); polybutenyl benzylamine; polybutenyl amine; and a derivative thereof, such as a borated material. These ashless dispersants can be contained either alone or in arbitrary combination of two or more thereof.

(VI-i)

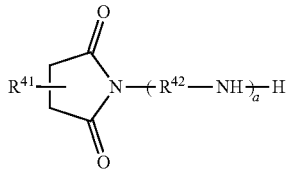

(VI-ii)

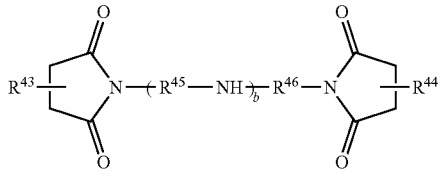

In the general formulae (VI-i) and (VI-ii), $R^{41}$, $R^{43}$, and $R^{44}$ each independently represent an alkenyl group or an alkyl group each having a number average molecular weight (Mn) of 500 or more and 3,000 or less. The number average molecular weights of $R^{41}$, $R^{43}$, and $R^{44}$ are each independently 1,000 or more and 3,000 or less. In addition, $R^{42}$, $R^{45}$, and $R^{46}$ each independently represent an alkylene, group having a carbon number of 2 or more and 5 or less.

a represents an integer of 1 or more and 10 or less, and b represents 0 or an integer of 1 or more and 10 or less.

When the number average molecular weight of each of $R^{41}$, $R^{43}$, and $R^{44}$ is 500 or more, the solubility in the base oil is improved, and when it is 3,000 or less, a lowering of detergency can be suppressed.

Examples of the alkenyl group represented by $R^{41}$, $R^{43}$, and $R^{44}$ may include a polybutenyl group, a polyisobutenyl group, and an ethylene-propylene copolymer, and examples of the alkyl group include those resulting from hydrogenation of the foregoing groups.

As a preferred example of the alkenyl group, there is exemplified a polybutenyl group or a polyisobutenyl group. The polybutenyl group is obtained through polymerization of a mixture of 1-butene and isobutene or high-purity isobutene. In addition, as a preferred example of the alkyl group, there is exemplified one resulting from hydrogenation of a polybutenyl group or a polyisobutenyl group.

In the general formula (VI-i), a is an integer of preferably 2 or more and 5 or less, and more preferably 3 or more and 4 or less. When a is 1 or more, the detergency is improved, and when a is 10 or less, worsening of solubility in the base oil can be suppressed.

In the general formula (VI-ii), b is an integer of preferably 1 or more and 4 or less, and more preferably 2 or more and 3 or less. What b falls within the foregoing range is preferred from the standpoints of detergency and solubility in the base oil.

The aforementioned alkenyl- or alkylsuccinimide compound can be, for example, produced by allowing an alkenyl succinic anhydride obtained through a reaction of a polyolefin and maleic anhydride, or an alkyl succinic anhydride obtained through hydrogenation of the foregoing alkenyl succinic anhydride, to react with a polyamine.

The aforementioned mono-type succinimide compound and bis-type succinimide compound can be, for example, produced by changing a reaction ratio of an alkenyl succinic anhydride or alkyl succinic anhydride and a polyamine.

As an olefin monomer that forms the aforementioned polyolefin, though one or a mixture of two or more of α-olefins having a carbon number of 2 or more and 8 or less can be preferably used, a mixture of 1-butene and isobutene can be more preferably used.

Examples of the aforementioned polyamine include mono diamines, such as ethylenediamine, propylenediamine, butylenediamine, and pentylenediamine; pollyalkylene polyamines, such as diethylenetriamine, triethylenetetramine, tetraethylenepentamine, pentaethylenehexamine, di(methylethylene)triamine, dibutylenetriamine, tributylenetetramine, and pentapentylenehexamine; and piperazine derivatives, such as aminoethylpiperazine.

In addition to the aforementioned alkenyl- or alkylsuccinimide compound, there may also be used boron derivatives thereof and/or organic acid-modified products thereof. As the boron derivative of the alkenyl- or alkylsuccinimide compound, those produced by an ordinary method can be used.

For example, the boron derivative is obtained by allowing the aforementioned polyolefin to react with maleic anhydride to form an alkenyl succinic anhydride, which is then allowed to react with an intermediate obtained through a reaction of the aforementioned polyamine and a boron compound, such as boron oxide, a boron halide, boric acid, boric anhydride, a boric acid ester, and an ammonium salt of orthoboric acid, thereby performing imidization.

Although the content of boron in this boron derivative is not particularly limited, it is preferably 0.05 mass % or more, and more preferably 0.10 mass % or more, and it is preferably 5.0 mass % or less, and more preferably 3.0 mass % or less, in terms of boron.

The content of the succinimide compound is preferably 0.5 mass % or more, and more preferably 1.0 mass % or more, and it is preferably 15 mass % or less, more preferably 10 mass % or less, and still more preferably 7.0 mass % or less, on the basis of the whole amount of the lubricating oil composition. When the content of the succinimide compound is 0.5 mass % or more, the effect is exhibited, whereas when it is 15 mass % or less, the effect corresponding to the addition thereof can be obtained.

Examples of the antioxidant include a phenol-based antioxidant, an amine-based antioxidant, and a molybdenum amine complex-based antioxidant.

Examples of the phenol-based antioxidant include 4,4'-methylenebis(2,6-di-tert-butylphenol), 4,4'-bis(2,6-di-tert-butylphenol), 4,4'-bis(2-methyl-6-tert-butylphenol), 2,2'-methylenebis(4-ethyl-6-tert-butylphenol), 2,2'-methylenebis(4-methyl-6-tert-butylphenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,6-di-tert-butyl-4-methylphenol, 2,6-di-tert-butyl-4-ethylphenol, 2,4-dimethyl-6-tert-butylphenol, 2,6-di-tert-amyl-p-cresol, 2,6-di-tert-butyl-4-(N,N'-dimethylaminomethylphenol), 4,4'-thiobis(2-methyl-6-tert-butylphenol), 4,4'-thiobis(3-methyl-6-tert-butylphenol), 2,2'-thiobis(4-methyl-6-tert-butylphenol), bis(3-methyl-4-hydroxy-5-tert-butylbenzyl) sulfide, bis(3,5-di-tert-butyl-4-hydroxybenzyl) sulfide, n-octyl-3-(4-hydroxy-3,5-di-tert-butylphenyl) propionate, n-octadecyl-3-(4-hydroxy-3,5-di-tert-butylphenyl) propionate, 2,2'-thio[diethyl-bis-3-(3,5-di-tert-butyl-4-hydroxyphenol) propionate], and a benzenepropanoic acid, 3,5-bis(1,1-dimethyl-ethyl)-4-hydroxy-C7-C9 branched alkyl esters. Of those, the phenol-based antioxidant is preferably a bisphenol-based or ester group-containing phenol-based antioxidant, more preferably an ester group-containing phenol-based antioxidant, and still more preferably a benzenepropanoic acid, 3,5-bis(1,1-dimethyl-ethyl-4-hydroxy-C7-C9 branched alkyl esters.

These phenol-based antioxidants can be contained either alone or in arbitrary combination of two or more thereof. The content thereof is preferably 0.01 mass % or more, more preferably 0.05 mass % or more, and still more preferably 0.10 mass % or more, and it is preferably 1.0 mass % or less, more preferably 5.0 mass % or less, and still more preferably 10 mass % or less, on the basis of the whole amount of the lubricating oil composition.

Examples of the amine-based antioxidant include monoalkyl diphenylamine-based compounds, such as monooctyl diphenylamine and monononyl diphenylamine; dialkyl diphenylamine-based compounds, such as 4,4'-diphenylamine, 4,4'-dipentyl diphenylamine, 4,4'-dihexyl diphenylamine, 4,4'-diheptyl diphenylamine, 4,4'-dioctyl diphenylamine, and 4,4'-dinonyl diphenylamine; polyalkyl diphenylamine-based compounds, such as tetrabutyl diphenylamine, tetrahexyl diphenylamine, tetraoctyl diphenylamine, and tetranonyl diphenylamine; phenylenediamine-based compounds, such as N,N'-diisopropyl-p-phenylenediamine, N,N'-diphenyl-p-phenylenediamine, and N-cyclohexyl-N'-phenyl-p-phenylenediamine; and naphthylamine-based compounds, such as α-naphthylamine, phenyl-α-naphthylamine, and alkyl-substituted phenyl-α-naphthylamines, e.g., butylphenyl-α-naphthylamine, pentylphenyl-α-naphthylamine, hexyphenyl-α-naphthylamine, heptylphenyl-α-naphthylamine, octylphenyl-α-naphthylamine, and nonylphenyl-α-naphthylamine. Of course, dialkyl diphenylamine-based or naphthylamine-based amine-based antioxidants are preferred.

These amine-based antioxidants can be contained either alone or in arbitrary combination of two or more thereof. The content thereof is preferably 0.01 mass % or more, more preferably 0.05 mass % or more, and still more preferably 0.10 mass % or more, and it is preferably 10 mass % or less, more preferably 5.0 mass % or less, and still more preferably 3.0 mass % or less, on the basis of the whole amount of the lubricating oil composition.

Examples of the other antioxidant include a sulfur-based antioxidant, such as dilauryl-3,3'-thiodipropionate, and a phosphorus-based antioxidant, such as a phosphite. As such an antioxidant, an arbitrary compound can be suitably selected and used among known antioxidants which have been conventionally used as an antioxidant of lubricating oil. These compounds may be used alone or may be used in combination of two or more thereof.

These antioxidants can be contained either alone or in arbitrary combination of two or more thereof and are preferably a phenol-based antioxidant and/or an amine-based antioxidant.

A total content of these antioxidants is preferably 0.01 mass % or more, more preferably 0.05 mass %, and still more preferably 0.10 mass % or more, and it is preferably 10 mass % or less, more preferably 5.0 mass % or less, and still more preferably 3.0 mass % or less, on the basis of the whole amount of the lubricating oil composition.

Examples of the other friction modifier and anti-wear agent include ashless friction modifiers; sulfur-based compounds, such as an olefin sulfide, a dialkyl polysulfide, a diarylalkyl polysulfide, and a diaryl polysulfide; phosphorus-based compounds, such as a phosphoric acid ester, a thiophosphoric acid, ester, a phosphorous acid ester, an alkyl hydrogen phosphite, a phosphoric acid ester amine salt, and a phosphorous acid ester amine salt; and organic metal-based compounds, such as zinc dithiocarbamate (ZnDTC). These friction modifiers or anti-wear agents can be contained either alone or in arbitrary combination of two or more thereof.

Examples of the ashless friction modifier include an aliphatic amine, a fatty acid ester, a fatty acid amide, a fatty acid, an aliphatic alcohol, and an aliphatic ether, each having at least one alkyl group or alkenyl group having a carbon number of 6 to 30, especially a linear alkyl group or linear alkenyl group having a carbon number of 6 to 30, in a molecule thereof. In addition, for example, an ester-based friction modifier, such as a partial ester compound obtained through a reaction of a fatty acid and an aliphatic polyhydric alcohol, can be used. The aforementioned fatty acid is preferably a fatty acid having a linear or branched hydrocarbon group having a carbon number of 6 or more and 30 or less, and the carbon number of the hydrocarbon group is more preferably 8 or more and 24 or less, and still more preferably 10 or more and 20 or less. In addition, the aliphatic polyhydric alcohol is a dihydric to hexahydric alcohol, and examples thereof include ethylene glycol, glycerin, trimethylolpropane, pentaerythritol, and sorbitol.

These may be used alone or may be used in combination of two or more thereof.

As the other friction modifier and anti-wear agent, it is preferred to make the metal component or sulfur component in the lubricating oil composition low as far as possible, and the ashless friction modifier is more preferred. The content thereof is preferably 5.0 mass % or less, more preferably 3.0 mass % or less, and still more preferably 1.5 mass % or less on the basis of the whole amount of the lubricating oil composition. In addition, in the case of using the other friction modifier and anti-wear agent, the content thereof is preferably 0.01 mass % or more on the basis of the whole amount of the lubricating oil composition.

Examples of the extreme pressure agent include sulfur-based compounds, such as an olefin sulfide, a dialkyl polysulfide, a diarylalkyl polysulfide, and a diaryl polysulfide; and phosphorus-based compounds, such as a phosphoric acid ester, a thiophosphoric acid ester, a phosphorous acid ester, an alkyl hydrogen phosphite, a phosphoric acid ester amine salt, and a phosphorous acid ester amine salt. These extreme pressure agents can be contained either alone or in arbitrary combination of two or more thereof.

In the case of using the extreme pressure agent, the content of the extreme pressure agent is preferably 0.01 mass % or more and 10 mass % or less on the basis of the whole amount of the lubricating oil composition.

Examples of the metal deactivator include a benzotriazole-based compound, a tolyltriazole-based compound, a thiadiazole-based compound, an imidazole-based compound, and a pyrimidine-based compound.

Examples of the pour-point depressant include an ethylene-vinyl acetate copolymer, a condensate of a chlorinated paraffin and naphthalene, a condensate of a chlorinated paraffin and phenol, a polymethacrylate, and a polyalkylstyrene. Of those, a polymethacrylate is preferably used.

Examples of the anti-foaming agent include a polyacrylate, a silicone oil, a fluorosilicone oil, and a fluoroalkyl ether.

Examples of the surfactant or demulsifier include polyalkylene glycol-based nonionic surfactants, such as a polyoxyethylene alkyl ether, a polyoxyethylene alkylphenyl ether, and a polyoxyethylene alkylnaphthyl ether.

Examples of the rust inhibitor include a petroleum sulfonate, an alkylbenzene sulfonate, dinonylnaphthalene sulfonate, an alkenylsuccinic ester, and a polyhydric alcohol ester.

These other components can be contained either alone or in arbitrary combination of two or more thereof.

[Production Method of Lubricating Oil Composition]

The production method of a lubricating oil composition for sliding member having a coating film that is one embodiment of the present invention is concerned with a production method including blending a base oil with (A) a zinc dialkyldithiophosphate and (B) a metallic detergent in such a manner that the content of sulfur atom (S) is 2,800 ppm by mass or less on the basis of the whole amount of the lubricating oil composition, and a mass ratio of the content of sulfur atom (S) and the content of metal atom (BM) derived from the component (B) [(5)/(BM)] in the lubricating oil composition is 0.07 or more and 2.90 or less.

In the production method of a lubricating oil composition that is one embodiment of the present invention, the base oils may be further blended with other components than the components (A) and (B). In the production method of a lubricating oil composition that is a preferred embodiment of the present invention, a component (C) is further blended. In addition, in the production method of a lubricating oil composition that is a preferred one embodiment of the present invention, the base oil may be further blended other components than the components (A) to (C).

The base oil, the aforementioned components (A) to (C), and other components are the same as those described above, respectively, and the lubricating oil composition obtained by the foregoing production methods is described previously. Thus, their descriptions are omitted.

In the foregoing production methods, the aforementioned components (A) to (C) and other components may be blended in the base oil by any method, and a method thereof is not limited.

[Lubrication Method Using Lubricating Oil Composition]

As the lubrication method using the lubricating oil composition that is one embodiment of the present invention, there is exemplified a method of lubricating a sliding member having a coating film, and there is exemplified a method of lubricating a sliding member having a coating film by using the aforementioned lubricating oil composition.

Specifically, the lubrication method using a lubricating oil composition that is one embodiment of the present invention is concerned with a method for lubricating a sliding member having a coating film, including using a lubricating oil composition containing a base oil;

(A) a zinc dialkyldithiophosphate; and (B) a metallic detergent, wherein the content of sulfur atom (S) is 2,800 ppm by mass or less on the basis of the whole amount of the lubricating oil composition, and a mass ratio of the content of sulfur atom (S) and the content of metal atom (BM) derived from the component (B) [(S)/(BM)] in the lubricating oil composition is 0.07 or more and 2.90 or less.

Examples of the sliding member include engine members. Examples of the engine member include at least one selected from the group consisting of a piston ring, a cylinder liner, a timing chain, a cam, a bearing, a gear, a tappet, a rocker arm, and an engine bearing. Preferably, there is exemplified a method of lubricating between respective members according to such an engine member by using the aforementioned lubricating oil composition. In addition, more preferably, there is exemplified a method of filling the lubricating oil composition between the respective sliding members of a coated sliding member and a sliding member coming into contact with the foregoing sliding member and lubricating between the respective sliding member.

As mentioned above, the foregoing lubricating oil composition is suitably used for a sliding member having a coating film which is at least one selected from the group consisting of a chromium nitride film, a chromium carbide film, and a vanadium carbide film.

The foregoing lubricating oil composition is the same as the lubricating oil composition that is one embodiment of the present invention, and its preferred embodiments are the same. Thus, their descriptions are omitted.

[Application of Lubricating Oil Composition]

The lubricating oil composition that is one embodiment of the present invention can be preferably used as a lubricating oil for internal combustion engine having a sliding member having a coating film, such as a gasoline engine, a diesel engine, and a gas engine, of an automobile, e.g., a two-wheeled vehicle and a four-wheeled vehicle, a power generator, and a ship. More preferably, the lubricating oil composition that is one embodiment of the present invention can be used as a lubricating oil for lubricating an internal combustion engine including a sliding member having a coating film and a coating film-free sliding member coming into contact with the foregoing sliding member.

Then, the lubricating oil composition that is one embodiment of the present invention can be preferably used for filling in such an internal combustion engine and lubricating the respective parts according to such an internal combustion engine.

[Internal Combustion Engine]

The internal combustion engine that is one embodiment of the present invention is an internal combustion engine filled with a lubricating oil composition for sliding member having a coating film, the lubricating oil composition containing:

a base oil;

(A) a zinc dialkyldithiophosphate; and (B) a metallic detergent, wherein the content of sulfur atom (S) is 2,800 ppm by mass or less on the basis of the whole amount of the lubricating oil composition, and a mass ratio of the content of sulfur atom (S) and the content of metal atom (BM) derived from the component (B) [(S)/(BM)] in the lubricating oil composition is 0.07 or more and 2.90 or less;

more preferably an internal combustion engine having a sliding member having a coating film, which is filled with the foregoing lubricating oil composition; and still more preferably an internal combustion engine including a sliding member having a coating film, which is filled with the foregoing lubricating oil composition, and a coating film-free sliding member coming into contact with the foregoing sliding member.

Examples of the internal combustion engine include a gasoline engine, a diesel engine, and a gas engine of an automobile, such as a two-wheeled vehicle and a four-wheeled vehicle, a power generator, and a ship.

The foregoing lubricating oil composition is the same as the lubricating oil composition that is one embodiment of the present invention, and its preferred embodiments are the same. Thus, their descriptions are omitted.

EXAMPLES

The present invention is described in more detail by reference to Examples, but it should be construed that the present invention is by no means limited by these Examples.

In the present specification, various physical properties of respective raw materials used in each of the Examples and Comparative Examples and a lubrication oils composition of each of the Examples and Comparative Examples were determined according to the following procedures.

<Kinematic Viscosity>

The kinematic viscosity is a value measured using a glass capillary viscometer in conformity with JIS K2283:2000.

<Viscosity Index>

The viscosity index is a value measured in conformity with JIS K2283:2000.

<NOACK Value>

The NOACK value is a value measured in conformity with the method prescribed in ASTM D5800 (at 250° C. for one hour).

<Ring Analysis (% $C_A$ and % $C_P$)>

A proportion (percentage) of aromatic components and a proportion (percentage) of paraffin components as calculated by the ring analysis n-d-M method are expressed as % $C_A$ and % $C_P$, respectively. These are those measured in conformity with ASTM D-3238.

<Base Number (Perchloric Acid Method)>

The measurement was performed by the potentiometric titration method (base number/perchlorate method) in conformity with JIS K2501:2003.

<Content of Sulfur Atom>

The content of sulfur atom is a value measured in conformity with JIS K2541-6.

<Contents of Metal Components: Calcium Atom, Magnesium Atom, Sodium Atom, Molybdenum Atom, Boron Atom, Zinc Atom, and Phosphorus Atom>

The measurement was performed in conformity with JPI-5S-38-2003.

<Sulfated Ash Content>

The measurement was performed in conformity with JIS K2272.

<SSI (Shear Stability Index)>

The measurement was performed in conformity with ASTM D6278.

<Mass Average Molecular Weight (Mw) and Number Average Molecular Weight (Mn)>

The measurement was performed using a gel permeation chromatograph ("1260 Model HPLC", manufactured by Agilent) under the following conditions, and values as expressed in terms of standard polystyrene were used.

(Measurement Conditions)

Column: One in which two of "Shodex LF404" are successively connected to each other Column temperature: 35° C.

Developing solvent: Chloroform

Flow rate: 0.3 in mL/min

Evaluation methods of the lubricating oil composition of each of the Examples and Comparative Examples are as follows.

[Falex Wear Test]

(1) The following were prepared as pin/block.

VC-coated pin: One obtained by coating the surface of a pin made of carbon steel SSOC with vanadium carbide CrN-coated pin: One obtained by coating the surface of a pin made of carbon steel S50C with chromium nitride Block: A block made of carbon steel S50C (2) Wear Test:

The following test was performed in conformity with ASTM D2670 by using a Falex tester and using, as a pin, the VC-coated pin in each of Examples 1 to 11 and Comparative Examples 1 to 3 as mentioned later and the CrN-coated pin in each of Examples 12 to 22 and Comparative Examples 4 to 6 as mentioned later.

The pin and the block were set in the Falex tester; 100 mL of the lubricating oil composition that is objective to the test was introduced into the inside of a test vessel; the test vessel was set at a rotation number of 1,420 r/min, an oil temperature of 80° C., and a load of 2,000 N and operated for 60 minutes, thereby measuring a wear amount (mg) of each of the pin and the block and confirming discoloration of the pin before and after the test through visual inspection. The wear amount in each of the tables was expressed as a total value of the wear amounts of the pin and the block.

In addition, the temperature of the lubricating oil composition measured immediately after termination of the test time was defined as "Oil temperature immediately after termination of Falex test". The higher the oil temperature, the larger the temperature rise of the sliding member due to friction.

Examples 1 to 22 and Comparative Example 1 to 6

A base oil was blended with respective components shown in each of the following Tables 1 to 4 in a composition shown in each of the following Tables 1 to 4, thereby preparing a lubricating oil composition of each of the Examples and Comparative Examples containing the base oil and these respective components. In addition, the lubricating oil composition of each of the Examples and Comparative Examples was evaluated according to the aforementioned evaluation methods. The obtained results are shown in the following Tables 1 to 4.

The respective components shown in the following Tables 1 to 4 are expressed as follows.

<Base Oil>

Lubricant base oil: Hydrorefined base: oil, kinematic viscosity at 40° C.=18.2 $mm^2/s$, kinematic viscosity at 100° C.=4.15 $mm^2/s$, viscosity index=134, content of sulfur=0 ppm by mass, NOACK value=13.3 mass %, n-d-M ring analysis; % $C_A$=0.2, % $C_P$=89.4

<Component (A): Zinc Dialkyldithiophosphate>

ZnDTP: A mixture of a compound represented by the general formula (I), in which $R^1$ to $R^4$ are a secondary propyl group and a compound represented by the general formula (I), in which $R^1$ to $R^4$ are a secondary hexyl group (content of zinc atom=7.85 mass %, content of phosphorus atom=7.2 mass % content of sulfur atom=14.4 mass %)

<Component (B): Metallic Detergent>

Calcium-based (Ca-based) detergent: Overbased calcium salicylate [base number (perchloric acid method)=350 mgKOH/g, content of calcium=12.5 mass %, content of sulfur=0.14 mass %]

Magnesium-based (Mg-based) detergent: Overbased magnesium sultanate [base number (perchloric acid method)=397 mgKOH/g, content of magnesium=9.5 mass %, content of sulfur=2.5 mass %]

Sodium-based (Na-based) detergent: Overbased sodium sulfonate [base number (perchloric acid method)=448 mgKOH/g, content of sodium=1.9.5 mass %, content of sulfur=1.2 mass %]

<Component (C): Molybdenum (Mo)-Based Friction Modifier>

Organic molybdenum compound: "SAKURA-LUBE (registered trademark) 515" (a product name, manufactured by Adeka Corporation) having a content of molybdenum of 10.0 mass % and a content of sulfur of 11.5 mass %, which is a binuclear molybdenum dithiocarbamate represented by the general formula (c11-2), in which $R^{11}$ to $R^{14}$ are each a hydrocarbon group having a carbon number of 8 or 13, and $X^{11}$ to $X^{14}$ are an oxygen atom <Viscosity Index Improver>

PMA: Polyalkyl (methacrylate, weight average molecular weight (Mw)=400,000, SSI=31.8, resin component: 10 mass %

<Ashless Dispersant>

Borated polybutenyl succinic monoimide: number average molecular weight (Mn) of polybutenyl group=1,000, content of nitrogen=1.23 mass %, content of boron=1.30 mass %

Polybutenyl succinic bisimide: number average molecular weight (Mn) of 1,300, content of nitrogen=0.99 mass %

<Ashless Friction Modifier>

Glycerin monooleate

<Antioxidant>

"IRGANOX (registered trademark) L135" [a trade name, manufactured by BASF SE, a benzenepropanoic acid, 3,5-bis(1,1-dimethyl-ethyl)-4-hydroxy-C7-C9 branched alkyl esters]

<Other Additives>

Metal deactivator, pour-point depressant, and anti-foaming agent

TABLE 1

| | | | Unit | Example 1 | Example 2 | Example 3 | Example 4 | Example 5 | Example 6 |
|---|---|---|---|---|---|---|---|---|---|
| Composition of lubricating oil composition | | Base oil | — | Balance | Balance | Balance | Balance | Balance | Balance |
| | Component (A) | Zinc dialkyldithiophosphate | mass % | 1.14 | 1.14 | 1.14 | 1.14 | 1.14 | 1.14 |
| | Component (B) | Calcium-based detergent | mass % | 3.51 | 2.10 | 1.72 | 0.85 | 1.72 | 1.72 |
| | | Magnesium-based detergent | mass % | — | — | — | — | — | — |
| | | Sodium-based detergent | mass % | — | — | — | — | — | — |

TABLE 1-continued

| | | | | | | | | | |
|---|---|---|---|---|---|---|---|---|---|
| | Component (C) | Molybdenum-based friction modifier | mass % | — | — | — | — | — | 0.30 |
| | Viscosity index improver | | mass % | 9.00 | 9.00 | 9.00 | 9.00 | 9.00 | 9.00 |
| | Borated polybutenyl succinic monoimide | | mass % | 2.00 | 2.00 | 2.00 | 2.00 | 2.00 | 2.00 |
| | Polybutenyl succinic bisimide | | mass % | 3.00 | 3.00 | 3.00 | 3.00 | 3.00 | 3.00 |
| | Ashless friction modifier | | mass % | 0.50 | 0.50 | 0.50 | 0.50 | 0.50 | 0.50 |
| | Antioxidant | | mass % | 0.50 | 0.50 | 0.50 | 0.50 | 0.50 | 0.50 |
| | Other additives | | mass % | 1.66 | 1.66 | 1.66 | 1.66 | 1.66 | 1.66 |
| | Total | | mass % | 100.00 | 100.00 | 100.00 | 100.00 | 100.00 | 100.00 |
| Properties of lubricating oil composition | Content of sulfur (S) | | mass ppm | 1600 | 1600 | 1600 | 1600 | 700 | 1900 |
| | Metal component | Content of calcium (Ca) | mass ppm | 4250 | 2540 | 2080 | 1020 | 2090 | 2060 |
| | | Content of magnesium (Mg) | mass ppm | — | — | — | — | — | — |
| | | Content of sodium (Na) | mass ppm | — | — | — | — | — | — |
| | | Content of molybdenum (Mo) | mass ppm | — | — | — | — | — | 312 |
| | [(S)/(BM)] mass ratio *1 | | — | 0.38 | 0.63 | 0.77 | 1.57 | 0.33 | 0.92 |
| | [(Mo)/(BM)] mass ratio *1 | | — | — | — | — | — | — | 0.15 |
| | Sulfated ash content | | mass % | 1.62 | 1.10 | 0.90 | 0.55 | 0.78 | 0.92 |
| Characteristics of lubricating oil composition (results of Falex test) | Coating of test pin surface | | — | VC-coated | VC-coated | VC-coated | VC-coated | VC-coated | VC-coated |
| | Oil temperature immediately after termination of Falex test | | ° C. | 109 | 114 | 105 | 111 | 110 | 84 |
| | Total value of wear amounts of pin and block | | mg | 2.7 | 5.0 | 7.0 | 8.4 | 4.2 | 2.3 |
| | Discoloration of test pin | | — | Yes | Yes | Yes | Yes | Yes | No |

| | | | | Unit | Example 7 | Example 8 | Example 9 | Example 10 | Example 11 |
|---|---|---|---|---|---|---|---|---|---|
| | Composition of lubricating oil composition | Base oil | | — | Balance | Balance | Balance | Balance | Balance |
| | | Component (A) | Zinc dialkyldithio-phosphate | mass % | 1.14 | 1.14 | 1.14 | 1.14 | 1.14 |
| | | Component (B) | Calcium-based detergent | mass % | 1.72 | 0.85 | 1.41 | 1.32 | 0.32 |
| | | | Magnesium-based detergent | mass % | — | — | — | 0.40 | — |
| | | | Sodium-based detergent | mass % | — | — | — | — | 0.90 |
| | | Component (C) | Molybdenum-based friction modifier | mass % | 0.70 | 0.80 | 0.10 | — | — |
| | | Viscosity index improver | | mass % | 9.00 | 9.00 | 9.00 | 9.00 | 9.00 |
| | | Borated polybutenyl succinic monoimide | | mass % | 2.00 | 2.00 | 2.00 | 2.00 | 2.00 |
| | | Polybutenyl succinic bisimide | | mass % | 3.00 | 3.00 | 3.00 | 3.00 | 3.00 |
| | | Ashless friction modifier | | mass % | 0.50 | 0.50 | 0.50 | 0.50 | 0.50 |
| | | Antioxidant | | mass % | 0.50 | 0.50 | 0.50 | 0.50 | 0.50 |
| | | Other additives | | mass % | 1.66 | 1.66 | 1.66 | 1.66 | 1.66 |
| | | Total | | mass % | 100.00 | 100.00 | 100.00 | 100.00 | 100.00 |
| | Properties of lubricating oil composition | Content of sulfur (S) | | mass ppm | 2400 | 2500 | 1700 | 1600 | 1700 |
| | | Metal component | Content of calcium (Ca) | mass ppm | 2080 | 1020 | 1710 | 1600 | 400 |
| | | | Content of magnesium (Mg) | mass ppm | — | — | — | 400 | — |
| | | | Content of sodium (Na) | mass ppm | — | — | — | — | 1600 |
| | | | Content of molybdenum (Mo) | mass ppm | 724 | 812 | 100 | — | — |
| | | [(S)/(BM)] mass ratio *1 | | — | 1.15 | 2.45 | 0.99 | 0.80 | 0.85 |
| | | [(Mo)/(BM)] mass ratio *1 | | — | 0.35 | 0.80 | 0.06 | — | — |
| | | Sulfated ash content | | mass % | 0.94 | 0.60 | 0.77 | 0.86 | 0.76 |
| | Characteristics of lubricating oil composition (results of Falex test) | Coating of test pin surface | | — | VC-coated | VC-coated | VC-coated | VC-coated | VC-coated |
| | | Oil temperature immediately after termination of Falex test | | ° C. | 78 | 77 | 94 | 115 | 114 |
| | | Total value of wear amounts of pin and block | | mg | 1.3 | 0.3 | 3.4 | 6.5 | 6.9 |
| | | Discoloration of test pin | | — | No | No | Yes | Yes | Yes |

*1 (BM) = (Ca) + (Mg) + (Na); namely, the content of metal atom derived from the component (B)

TABLE 2

| | | | Unit | Comparative Example 1 | Comparative Example 2 | Comparative Example 3 |
|---|---|---|---|---|---|---|
| Composition of lubricating oil composition | | Base oil | — | Balance | Balance | Balance |
| | Component (A) | Zinc dialkyldithiophosphate | mass % | 1.14 | 2.05 | 2.05 |
| | Component (B) | Calcium-based detergent | mass % | 0.42 | 0.42 | 1.72 |
| | | Magnesium-based detergent | mass % | — | — | — |
| | | Sodium-based detergent | mass % | — | — | — |
| | Component (C) | Molybdenum-based friction modifier | mass % | — | — | — |
| | | Viscosity index improver | mass % | 9.00 | 9.00 | 9.00 |
| | | Borated polybutenyl succinic monoimide | mass % | 2.00 | 2.00 | 2.00 |
| | | Polybutenyl succinic bisimide | mass % | 3.00 | 3.00 | 3.00 |
| | | Ashless friction modifier | mass % | 0.50 | 0.50 | 0.50 |
| | | Antioxidant | mass % | 0.50 | 0.50 | 0.50 |
| | | Other additives | mass % | 1.66 | 1.66 | 1.66 |
| | | Total | mass % | 100.00 | 100.00 | 100.00 |
| Properties of lubricating oil composition | | Content of sulfur (S) | mass ppm | 1600 | 2900 | 2900 |
| | Metal component | Content of calcium (Ca) | mass ppm | 529 | 509 | 2060 |
| | | Content of magnesium (Mg) | mass ppm | — | — | — |
| | | Content of sodium (Na) | mass ppm | — | — | — |
| | | Content of molybdenum (Mo) | mass ppm | — | — | — |
| | | [(S)/(BM)] mass ratio *1 | — | 3.02 | 5.70 | 1.41 |
| | | [(Mo)/(BM)] mass ratio *1 | — | — | — | — |
| | | Sulfated ash content | mass % | 0.40 | 0.57 | 1.09 |
| Characteristics of lubricating oil composition (results of Falex test) | | Coating of test pin surface | — | VC-coated | VC-coated | VC-coated |
| | | Oil temperature immediately after termination of Falex test | ° C. | 121 | 126 | 129 |
| | | Total value of wear amounts of pin and block | mg | 9.1 | 10.6 | 10.8 |
| | | Discoloration of test pin | — | Yes | Yes | Yes |

*1 (BM) = (Ca) + (Mg) + (Na); namely, the content of metal atom derived from the component (B)

TABLE 3

| | | | Unit | Example 12 | Example 13 | Example 14 | Example 15 | Example 16 | Example 17 |
|---|---|---|---|---|---|---|---|---|---|
| Composition of lubricating oil composition | | Base oil | — | Balance | Balance | Balance | Balance | Balance | Balance |
| | Component (A) | Zinc dialkyldithiophosphate | mass % | 1.14 | 1.14 | 1.14 | 1.14 | 0.46 | 1.14 |
| | Component (B) | Calcium-based detergent | mass % | 3.51 | 2.10 | 1.72 | 0.85 | 1.72 | 1.72 |
| | | Magnesium-based detergent | mass % | — | — | — | — | — | — |
| | | Sodium-based detergent | mass % | — | — | — | — | — | — |
| | Component (C) | Molybdenum-based friction modifier | mass % | — | — | — | — | — | 0.30 |
| | | Viscosity index improver | mass % | 9.00 | 9.00 | 9.00 | 9.00 | 9.00 | 9.00 |
| | | Borated polybutenyl succinic monoimide | mass % | 2.00 | 2.00 | 2.00 | 2.00 | 2.00 | 2.00 |
| | | Polybutenyl succinic bisimide | mass % | 3.00 | 3.00 | 3.00 | 3.00 | 3.00 | 3.00 |
| | | Ashless friction modifier | mass % | 0.50 | 0.50 | 0.50 | 0.50 | 0.50 | 0.50 |
| | | Antioxidant | mass % | 0.50 | 0.50 | 0.50 | 0.50 | 0.50 | 0.50 |
| | | Other additives | mass % | 1.66 | 1.66 | 1.66 | 1.66 | 1.66 | 1.66 |
| | | Total | mass % | 100.00 | 100.00 | 100.00 | 100.00 | 100.00 | 100.00 |
| Properties of lubricating oil composition | | Content of sulfur (S) | mass ppm | 1600 | 1600 | 1600 | 1600 | 700 | 1900 |
| | Metal component | Content of calcium (Ca) | mass ppm | 4250 | 2540 | 2080 | 1020 | 2090 | 2060 |
| | | Content of magnesium (Mg) | mass ppm | — | — | — | — | — | — |
| | | Content of sodium (Na) | mass ppm | — | — | — | — | — | — |
| | | Content of molybdenum (Mo) | mass ppm | — | — | — | — | — | 312 |
| | | [(S)/(BM)] mass ratio *1 | — | 0.38 | 0.63 | 0.77 | 1.57 | 0.33 | 0.92 |
| | | [(Mo)/(BM)] mass ratio *1 | — | — | — | — | — | — | 0.15 |
| | | Sulfated ash content | mass % | 1.62 | 1.10 | 0.90 | 0.55 | 0.78 | 0.92 |
| Characteristics of lubricating oil composition (results of Falex test) | | Coating of test pin surface | — | CrN-coated | CrN-coated | CrN-coated | CrN-coated | CrN-coated | CrN-coated |
| | | Oil temperature immediately after termination of Falex test | ° C. | 106 | 117 | 107 | 113 | 106 | 77 |
| | | Total value of wear amounts of pin and block | mg | 1.0 | 2.0 | 2.3 | 1.8 | 1.6 | 0.0 |
| | | Discoloration of test pin | — | Yes | Yes | Yes | Yes | Yes | No |

TABLE 3-continued

| | | | | Unit | Example 18 | Example 19 | Example 20 | Example 21 | Example 22 |
|---|---|---|---|---|---|---|---|---|---|
| Composition of lubricating oil composition | Base oil | | | — | Balance | Balance | Balance | Balance | Balance |
| | Component (A) | Zinc dialkyldithio-phosphate | | mass % | 1.14 | 1.14 | 1.14 | 1.14 | 1.14 |
| | Component (B) | Calcium-based detergent | | mass % | 1.72 | 0.85 | 1.41 | 1.32 | 0.32 |
| | | Magnesium-based detergent | | mass % | — | — | — | 0.40 | — |
| | | Sodium-based detergent | | mass % | — | — | — | — | 0.90 |
| | Component (C) | Molybdenum-based friction modifier | | mass % | 0.70 | 0.80 | 0.10 | — | — |
| | Viscosity index improver | | | mass % | 9.00 | 9.00 | 9.00 | 9.00 | 9.00 |
| | Borated polybutenyl succinic monoimide | | | mass % | 2.00 | 2.00 | 2.00 | 2.00 | 2.00 |
| | Polybutenyl succinic bisimide | | | mass % | 3.00 | 3.00 | 3.00 | 3.00 | 3.00 |
| | Ashless friction modifier | | | mass % | 0.50 | 0.50 | 0.50 | 0.50 | 0.50 |
| | Antioxidant | | | mass % | 0.50 | 0.50 | 0.50 | 0.50 | 0.50 |
| | Other additives | | | mass % | 1.66 | 1.66 | 1.66 | 1.66 | 1.66 |
| | Total | | | mass % | 100.00 | 100.00 | 100.00 | 100.00 | 100.00 |
| Properties of lubricating oil composition | Content of sulfur (S) | | | mass ppm | 2400 | 2500 | 1700 | 1600 | 1700 |
| | Metal component | Content of calcium (Ca) | | mass ppm | 2080 | 1020 | 1710 | 1600 | 400 |
| | | Content of magnesium (Mg) | | mass ppm | — | — | — | 400 | — |
| | | Content of sodium (Na) | | mass ppm | — | — | — | — | 1600 |
| | | Content of molybdenum (Mo) | | mass ppm | 724 | 812 | 100 | — | — |
| | [(S)/(BM)] mass ratio *1 | | | — | 1.15 | 2.45 | 0.99 | 0.80 | 0.85 |
| | [(Mo)/(BM)] mass ratio *1 | | | — | 0.35 | 0.80 | 0.06 | — | — |
| | Sulfated ash content | | | mass % | 0.94 | 0.60 | 0.77 | 0.86 | 0.76 |
| Characteristics of lubricating oil composition (results of Falex test) | Coating of test pin surface | | | — | CrN-coated | CrN-coated | CrN-coated | CrN-coated | CrN-coated |
| | Oil temperature immediately after termination of Falex test | | | ° C. | 76 | 75 | 92 | 113 | 114 |
| | Total value of wear amounts of pin and block | | | mg | 0.0 | 0.0 | 1.3 | 2.1 | 2.3 |
| | Discoloration of test pin | | | — | No | No | Yes | Yes | Yes |

*1 (BM) = (Ca) + (Mg) + (Na); namely, the content of metal atom derived from the component (B)

TABLE 4

| | | | Unit | Comparative Example 4 | Comparative Example 5 | Comparative Example 6 |
|---|---|---|---|---|---|---|
| Composition of lubricating oil composition | Base oil | | — | Balance | Balance | Balance |
| | Component (A) | Zinc dialkyldithiophosphate | mass % | 1.14 | 2.05 | 2.05 |
| | Component (B) | Calcium-based detergent | mass % | 0.42 | 0.42 | 1.72 |
| | | Magnesium-based detergent | mass % | — | — | — |
| | | Sodium-based detergent | mass % | — | — | — |
| | Component (C) | Molybdenum-based friction modifier | mass % | — | — | — |
| | Viscosity index improver | | mass % | 9.00 | 9.00 | 9.00 |
| | Borated polybutenyl succinic monoimide | | mass % | 2.00 | 2.00 | 2.00 |
| | Polybutenyl succinic bisimide | | mass % | 3.00 | 3.00 | 3.00 |
| | Ashless friction modifier | | mass % | 0.50 | 0.50 | 0.50 |
| | Antioxidant | | mass % | 0.50 | 0.50 | 0.50 |
| | Other additives | | mass % | 1.66 | 1.66 | 1.66 |
| | Total | | mass % | 100.00 | 100.00 | 100.00 |
| Properties of lubricating oil composition | Content of sulfur (S) | | mass ppm | 1600 | 2900 | 2900 |
| | Metal component | Content of calcium (Ca) | mass ppm | 529 | 509 | 2060 |
| | | Content of magnesium (Mg) | mass ppm | — | — | — |
| | | Content of sodium (Na) | mass ppm | — | — | — |
| | | Content of molybdenum (Mo) | mass ppm | — | — | — |
| | [(S)/(BM)] mass ratio *1 | | — | 3.02 | 5.70 | 1.41 |
| | [(Mo)/(BM)] mass ratio *1 | | — | — | — | — |
| | Sulfated ash content | | mass % | 0.40 | 0.57 | 1.09 |
| Characteristics of lubricating oil composition (results of | Coating of test pin surface | | — | CrN-coated | CrN-coated | CrN-coated |
| | Oil temperature immediately after termination of Falex test | | ° C. | 122 | 121 | 115 |
| | Total value of wear amounts of pin and | | mg | 3.0 | 3.6 | 3.8 |

TABLE 4-continued

| | | Unit | Comparative Example 4 | Comparative Example 5 | Comparative Example 6 |
|---|---|---|---|---|---|
| Falex test) | block Discoloration of test pin | — | Yes | Yes | Yes |

*1 (BM) = (Ca) + (Mg) + (Na); namely, the content of metal atom derived from the component (B)

The results of Tables 1 and 2 are concerned with the results of the Examples and Comparative Examples in the case where the VC-coated pin was used as the pin for the Falex test, and the results of Tables 3 and 4 are concerned with the results of the Examples and Comparative Examples in the case where the CrN-coated pin was used as the pin for the Falex test.

As is clear from the results of Tables 1 and 3, it could be confirmed that the lubricating oil compositions of Examples 1 to 22 are able to not only reduce the temperature rise of a sliding member to be caused due to friction but also reduce wear of a sliding member having a coating film and a sliding member coming into contact with the foregoing sliding member.

Furthermore, it could be confirmed that in the lubricating oil compositions of Examples 6 to 9 and Examples 17 to 20, by containing a molybdenum-based friction modifier that is the component (C), the effect for suppressing a temperature rise of a sliding member to be caused due to friction was more excellent. In addition, in the lubricating oil compositions of Examples 6 to 8 and Examples 17 to 19 in which the value of the [(Mo)/(BM)] mass ratio is satisfied with a specified range, the foregoing effect for suppressing a temperature rise was more excellent, and the discoloration of the pin used for the Falex test was not generated.

On the other hand, the lubricating oil compositions of Comparative Examples 1 to 6 revealed the results that the temperature rise of a sliding member to be caused due to friction is large, and the wear amounts of a sliding member having a coating film and a sliding member coming into contact with the foregoing sliding member are large.

INDUSTRIAL APPLICABILITY

The lubricating oil composition of the present invention is a lubricating oil composition which is able to not only reduce a temperature rise of a sliding member to be caused due to friction but also reduce wear of a sliding member having a coating film and a sliding member coming into contact with the foregoing sliding member.

Accordingly, the lubricating oil composition of the present invention is preferred as a lubricating oil composition for a sliding member having a coating film and is more preferred as a lubricating oil composition for an internal combustion engine using the foregoing member.

The invention claimed is:

1. A lubricating oil composition comprising:

75 mass % or more and 97 mass % or less of a base oil comprising a mineral oil;

0.05 mass % or more and 1.50 mass % or less of (A) a zinc dialkyldithiophosphate;

(B) a calcium-based detergent;

a polyalkyl (meth)acrylate having a shear stability index (SSI) of 35 or less as a viscosity index improver; and (C) a molybdenum-based friction modifier;

wherein an aromatic content (% $C_A$) of the base oil is 1.0 or less, a paraffin content (% $C_P$) of the base oil is 75 or more, a content of molybdenum atom (Mo) derived from (C) the molybdenum-based friction modifier is 300 ppm by mass or more, an amount of sulfur atoms (S) is 2,800 ppm by mass or less based on a whole amount of the lubricating oil composition, a mass ratio (S)/(BM) of (S) to the amount of calcium atoms (BM) derived from (B) is 0.07 or more and 2.90 or less, and a mass ratio (Mo)/(BM) of an amount of molybdenum atoms (Mo) derived from (C) to (BM) is 0.05 or more and 1.00 or less.

2. The lubricating oil composition of claim 1, wherein a content of Ca (BM) is 800 ppm by mass or more and 4,500 ppm by mass or less based on the whole amount of the lubricating oil composition.

3. An engine member comprising the lubricating oil composition of claim 1 as a coating film on a sliding member, wherein the engine member is selected from the group consisting of a piston ring, a cylinder liner, a timing chain, a cam, a bearing, a gear, a tappet, a rocker arm and an engine bearing.

* * * * *